US008406680B2

(12) United States Patent
Murata

(10) Patent No.: US 8,406,680 B2
(45) Date of Patent: Mar. 26, 2013

(54) SHEET REVERSING DEVICE AND IMAGE FORMING APPARATUS

(75) Inventor: Koji Murata, Osaka (JP)

(73) Assignee: Kyocera Mita Corporation (JP)

( * ) Notice: Subject to any disclaimer, the term of this patent is extended or adjusted under 35 U.S.C. 154(b) by 448 days.

(21) Appl. No.: 12/752,193

(22) Filed: Apr. 1, 2010

(65) Prior Publication Data

US 2010/0254740 A1 Oct. 7, 2010

(30) Foreign Application Priority Data

Apr. 1, 2009 (JP) ..... 2009-089227

(51) Int. Cl.
*G03G 15/00* (2006.01)

(52) U.S. Cl. ..... 399/401; 400/645; 400/645.4

(58) Field of Classification Search ..... 399/401; 400/645, 645.4
See application file for complete search history.

(56) References Cited

U.S. PATENT DOCUMENTS 8,002,276 B2 * 8/2011 Ishikawa et al. ..... 271/242
8,229,342 B2 * 7/2012 Takagi ..... 399/401
2005/0254872 A1 * 11/2005 Nonaka et al. ..... 399/401
2007/0110489 A1 * 5/2007 Tsuji ..... 399/401
2007/0292189 A1 * 12/2007 Kim ..... 400/642
2008/0290585 A1 * 11/2008 Asada ..... 271/10.09

FOREIGN PATENT DOCUMENTS

JP 08301487 A * 11/1996
JP 2005-298186 10/2005

* cited by examiner

*Primary Examiner* — Daniel J Colilla
*Assistant Examiner* — Allister Primo
(74) *Attorney, Agent, or Firm* — Gerald E. Hespos; Michael J. Porco

(57) ABSTRACT

A sheet reversing device has a vertical first conveyance path, a horizontal second conveyance path into which a sheet is carried via the first conveyance path and a horizontally third conveyance path into which the switched-back sheet is carried from the second conveyance path. A curved guide plate is disposed between the first and second conveyance paths and includes a curved guide surface for guiding the sheet to the second conveyance path, and a pivotal guide pivotably supported with a part thereof projecting from the curved guide surface. The pivotal guide pivots to retract into the inner side of the curved guide by being pushed by the sheet moving from the first conveyance path toward the second conveyance path while guiding the sheet switched back and carried out from the second conveyance path toward the third conveyance path with the part thereof projecting from the curved guide surface.

16 Claims, 10 Drawing Sheets

SHEET REVERSING DEVICE AND IMAGE FORMING APPARATUS

BACKGROUND OF THE INVENTION

1. Field of the Invention

The present invention relates to a sheet reversing device for reversing a sheet by feeding the sheet received into the device in a reverse direction and an image forming apparatus employing this sheet reversing device.

2. Description of the Related Art

There has been conventionally known a sheet reversing device 90 as shown in FIG. 10B incorporated into an image forming apparatus 99 shown in FIG. 10A. This image forming apparatus 99 is capable of printing both sides of sheets. Sheets fed one by one from a sheet cassette 991 by a feed roller 992 is conveyed to a photoconductive drum 995 via a conveyance path 993 at a specified timing after having the leading end thereof stopped by a registration roller pair 994.

On the other hand, an electrostatic latent image formed on the photoconductive drum 995 based on input image information is developed into a toner image with toner supplied from an unillustrated developing device. This toner image is transferred to the sheet fed from the sheet cassette 991. The sheet having the toner image transferred thereto is conveyed to a fixing roller pair 996 composed of a heating roller and a pressure roller to be heated and pressed, whereby the toner image is fixed to the sheet.

Upon printing both sides of a sheet, the sheet having a toner image fixed to one side is conveyed to the sheet reversing device 90 via a first reversing path 998 after having its conveying direction changed by a branch guide 997. In the sheet reversing device 90, the sheet has its conveying direction reversed to be conveyed to a second reversing path 999. Thereafter, this sheet is conveyed to the registration roller pair 994 via the second reversing path 999, is given a process similar to the printing process applied to the one side is applied to the other side and is then discharged to a discharge tray 999*a* via the branch guide 997.

The sheet reversing device 90 used in such an image forming apparatus 99 includes a reversing tray 91 and a switchback roller pair 92 provided at a conveyance opening 911 of this reversing tray 91 as shown in FIG. 10B. A lower roller 921 of the switchback roller 92 is rotatably mounted in the device. On the other hand, an upper roller 922 of the switchback roller pair 92 is rotatably supported on a supporting member 94 mounted on a conveyance guide plate 93 pivotally about a shaft 931. This arrangement is employed to enable the circumferential surface of the upper roller 922 to be stably pressed into contact with the circumferential surface of the lower roller 921.

Further, an upper guide member 95 is so mounted as to face the reversing tray 91 above a widthwise center position of the reversing tray 91 at the side of the switchback roller pair 92. A cover 951 is so mounted as to cover the upper surface of this upper guide member 95. Further, an opening 952 is formed in a widthwise central part of the upper guide member 95. A sheet detecting switch 96 including a detection bar 961 is mounted on the underside of the cover 951, and the detection bar 961 projects downward through the opening 952. The sheet detecting switch 96 is for detecting a sheet jam on the reversing tray 91.

A coil spring 97 is disposed between the supporting member 94 and the cover 951 and constantly biases the supporting member 94 downward. Accordingly, the upper roller 922 is constantly biased in a direction to be held in contact with the lower roller 921. Thus, a larger pressing force can act as compared with the case of using only the weight of the upper roller 922, wherefore even thick sheets can be easily conveyed.

According to the sheet reversing device 90 constructed as above, a sheet having an image formed on one side is conveyed to the reversing tray 91 through the conveyance opening 911 by the switchback roller pair 92. At this time, the detection bar 961 of the sheet detecting switch 96 is touched and rotated by the sheet being conveyed, whereby the presence of the sheet is detected. When the trailing end of the sheet reaches a nip of the switchback roller pair 92, the switchback rollers 92 are rotated in reverse directions to convey the sheet to the conveyance path from the reversing tray 91. Thereafter, an image is formed on the other side of the sheet to complete a duplex printing process, and is discharged to the external discharge tray 999*a*.

In the above sheet reversing device 90, upon duplex printing, a sheet having one side printed passes through the first reversing path 998 and is conveyed onto the reversing tray 91 via the switchback roller pair 92. Thereafter, the sheet is pulled out from the reversing tray 91 by rotating the switchback rollers 92 in reverse directions and conveyed to the second reversing path 999.

Here, the sheet may be curled, for example, due to heat in the fixing roller pair 996 at an upstream side and the leading end thereof may be warped upward. In this case, the leading end of the sheet may face an upper side of a bottom end edge 998*a* of the first reversing path 998 to be guided to the lower end edge 998*a* and move toward the first reversing path 998 when the sheet is fed in the reverse direction from the reversing tray 91. If the sheet moves toward the first reversing path 998, the sheet cannot be reversed, whereby not only duplex printing cannot be performed, but also the sheet may be jammed in the first reversing path 998.

SUMMARY OF THE INVENTION

An object of the present invention is to provide a sheet reversing device capable of reliably reversing a sheet and an image forming apparatus employing this sheet reversing device.

In order to accomplish this object, one aspect of the present invention is directed to a sheet reversing device, including a first conveyance path that extends vertically; a second conveyance path that extends horizontally, into which a sheet is carried via the first conveyance path and from which the sheet is carried out after being switched back; a third conveyance path that extends horizontally, receives and conveys the sheet carried out from the second conveyance path; a curved guide plate disposed between the first and second conveyance paths and including a curved guide surface for guiding the sheet to the second conveyance path; and a pivotal guide member pivotably supported with a part thereof projecting from the curved guide surface, wherein the pivotal guide member pivots to be retracted into the inner side of the curved guide surface by being pushed by the sheet moving from the first conveyance path toward the second conveyance path while guiding the sheet switched back and carried out from the second conveyance path toward the third conveyance path with the part thereof projecting from the curved guide surface.

Another aspect of the present invention is directed to an image forming apparatus, including an image forming station for forming an image on a sheet; a main conveyance path for conveying the sheet toward the image forming station; and a sheet reversing device for reversing the sheet having an image formed on one side thereof in the image forming station and returning it to the main conveyance path, wherein the sheet reversing device has the above construction.

These and other objects, features and advantages of the present invention will become more apparent upon reading the following detailed description. Further, advantages of the present invention will become more apparent in the following description with reference to accompanying drawings.

BRIEF DESCRIPTION OF THE DRAWINGS

FIGS. 10A and 10B show a conventional sheet reversing device, wherein FIG. 10A is a front view in section of an image forming apparatus employing the sheet reversing device and FIG. 10B is a section of the sheet reversing device.

DETAILED DESCRIPTION OF THE PREFERRED EMBODIMENTS

Figure 1:
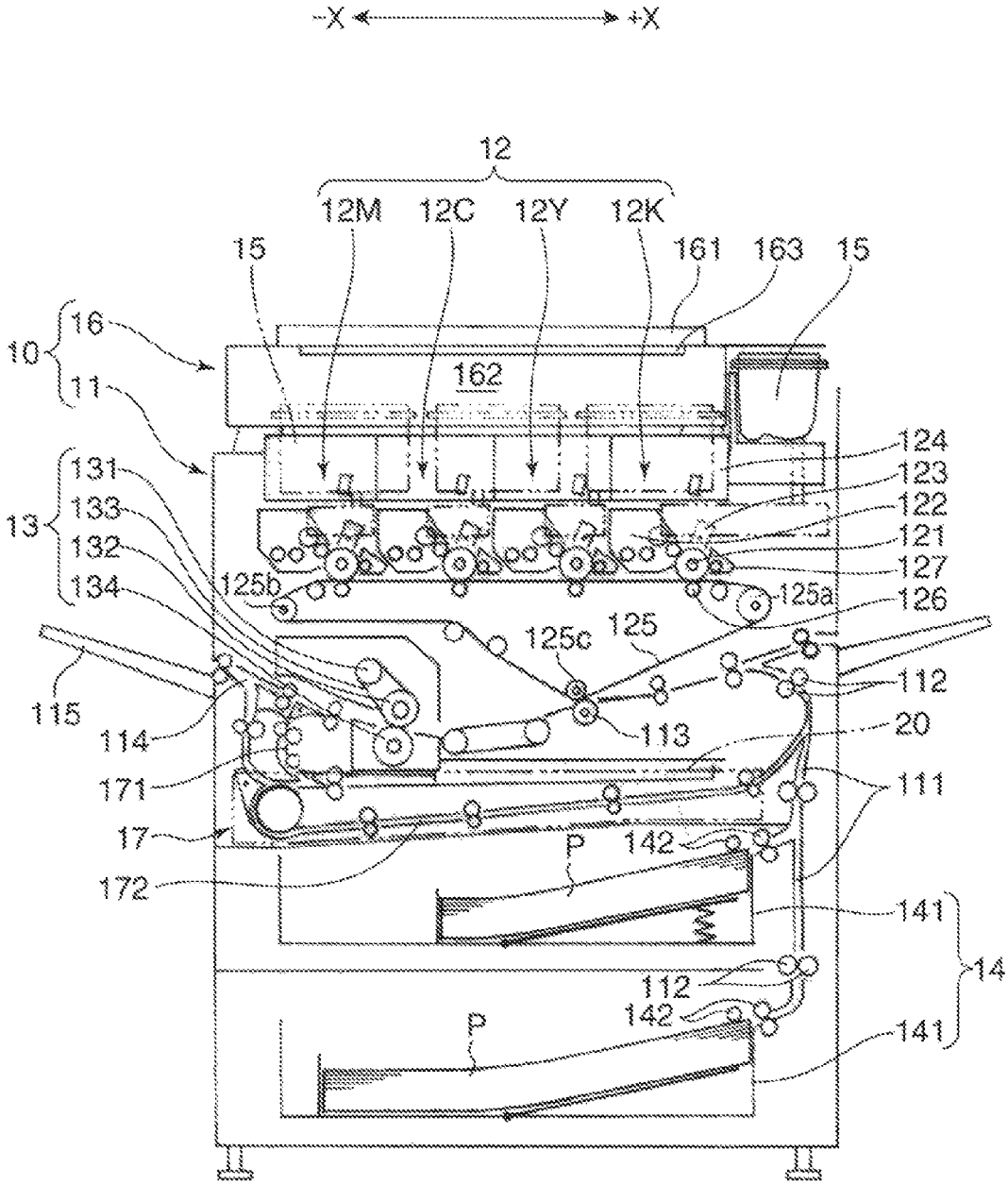
FIG. 1 is a front view in section showing the internal construction of an image forming apparatus according to one embodiment of the invention.

Hereinafter, one embodiment of the present invention is described in detail. First of all, an image forming apparatus 10 having a sheet reversing unit 20 (sheet reversing device) according to this embodiment assembled thereinto is outlined with reference to FIG. 1. FIG. 1 is a front view in section showing the internal construction of the image forming apparatus 10. In FIG. 1, X-X directions are lateral directions, particularly −X direction is leftward direction and +X direction is rightward direction.

The image forming apparatus 10 is used as a copier for color printing and provided, as a basic construction, with a box-shaped apparatus body 11 and an image reader 16 arranged above the apparatus body 11 for reading a document image. The apparatus body 11 houses an image forming station 12 for forming an image based on image information of a document read by the image reader 16, a fixing unit 13 for applying a fixing process to an image formed by the image forming station 12 and transferred to a sheet P, and a sheet storing unit 14 for storing sheets used for image transfer.

The image reader 16 includes a document pressing cover 161 openably and closably disposed on the upper surface of the apparatus body 11 and an optical system unit 162 for optically reading a document. The optical system unit 162 is accommodated in a housing in an upper part of the apparatus body 11 and arranged to face the document pressing cover 161 via a contact glass 163.

The document pressing cover 161 is opened and closed by being rotated in forward and reverse directions about a specified shaft disposed on one lateral side of the upper surface of a housing of the image reader 16. A document is placed on the contact glass 163 to have a document surface thereof read, and the planar shape of the contact glass 163 is set to be a rectangular shape slightly smaller than the document pressing cover 161.

An unillustrated operation panel used to input process conditions relating to document reading, copying process and the like is provided on the front side (front side of the plane of FIG. 1) of the image reader 16. This operation panel includes a power switch, a numerical pad, a start button, an LCD (liquid crystal display) and the like.

The optical system unit 162 includes an unillustrated light source, a plurality of mirrors, a lens unit, a CCD (charge coupled device) and the like. Light from the light source is reflected by a document surface, and this reflected light is incident on the CCD as document information via these mirrors and lens unit. The document information in the form of an analog signal output from the CCD is converted into a digital signal and stored in a specified storage device.

The image forming station 12 is for forming a toner image on a sheet fed from the sheet storing unit 14. The image forming station 12 includes a magenta unit 12M, a cyan unit 12C, a yellow unit 12Y and a black unit 12K successively arranged from an upstream side (left side in the plane of FIG. 1) toward a downstream side in this embodiment.

Each of the units 12M, 12C, 12Y and 12K includes a photoconductive drum 121 and a developing device 122. Each photoconductive drum 121 receives the supply of toner from the corresponding developing device 122 while being rotated in a counterclockwise direction in FIG. 1. Each toner is supplied to the respective developing devices 122 from toner containers 15 which are so arranged as to correspond to the developing devices 122 at the front side (front side of the plane of FIG. 1) of the apparatus body 11 and the right side of FIG. 1.

In this embodiment, the toner containers 15 for supplying toners of the respective colors to the developing devices 122 of the magenta, cyan and yellow units 12M, 12C and 12Y are detachably mounted at positions on the front upper corner of the apparatus body 11 and before the optical system unit 162. On the other hand, the toner container 15 for supplying black toner to the developing device 122 of the black unit 12K is detachably mounted above the apparatus body 11 and to the right of the optical system unit 162.

A charger 123 is arranged at a position right above each photoconductive drum 121. Further, an exposure device 124 is arranged above the chargers 123 and the developing devices 122. Each photoconductive drum 121 has its circumferential surface uniformly charged by the charger 123. The charged circumferential surfaces of the photoconductive drums 121 are irradiated with laser beams from the exposure device 124 corresponding to the respective colors and based on image data input from the image reader 16. As a result, electrostatic latent images corresponding to the respective colors are respectively formed on the circumferential surfaces of the respective photoconductive drums 121. Toners of the respective colors are supplied to the corresponding electrostatic latent images from the developing devices 122, whereby toner images are formed on the circumferential surfaces of the respective photoconductive drums 121.

A transfer belt 125 whose outer surface is held in contact with the circumferential surfaces of the respective photoconductive drums 121 is arranged below the photoconductive drums 121. The transfer belt 125 is mounted on a drive roller 125*a*, a driven roller 125*b*, a secondary transfer facing roller 125*c* and other necessary rollers. The transfer belt 125 is turned between the drive roller 125*a* and the driven roller 125*b* in synchronism with the respective photoconductive drums 121 while being pressed against the circumferential surfaces of the photoconductive drums 121 by primary transfer rollers 126 disposed in correspondence with the respective photoconductive drums 121.

By a turning movement of the transfer belt 125, a magenta toner image on the photoconductive drum 121 of the magenta unit 12M is transferred to the outer surface f the transfer belt 125 and subsequently a cyan toner image on the photoconductive drum 121 of the cyan unit 12C is transferred to the same position of the transfer belt 125 in a superimposition manner. Subsequently, a yellow toner image and a black toner image are similarly transferred in a superimposition manner by the yellow unit 12Y and the black unit 12K. Thus, a color toner image is formed on the outer surface of the transfer belt 125. The color toner image formed on the outer surface of the transfer belt 125 is transferred to a sheet P conveyed from the sheet storing unit 14.

A cleaning device 127 for cleaning the circumferential surface of the photoconductive drum 121 by removing the residual toner is arranged to the left of each photoconductive drum 121 in FIG. 1. The circumferential surface of the photoconductive drum 121 cleaned by the cleaning device 127 heads for the charger 123 for a new charging process. The waste toners removed from the circumferential surfaces of the photoconductive drums 121 are collected into unillustrated toner collection bottles via specified paths.

A sheet conveyance path (main conveyance path) 111 is formed from a position to the right of the sheet storing unit 14 to a position below the image forming station 12. A conveyor roller pair 112 is disposed at a suitable position in this sheet conveyance path 111. The sheet P fed from the sheet storing unit 14 is conveyed toward a position below the transfer belt 125 by driving the conveyor roller pair 112. A secondary transfer roller 113 held in contact with the outer surface of the transfer belt 125 is disposed at a position of the sheet conveyance path 111 facing the secondary transfer facing roller 125*c*. The sheet P being conveyed in the sheet conveyance path 111 is pressed and held between the transfer belt 125 and the secondary transfer roller 113, whereby the toner image on the transfer belt 125 is transferred to this sheet P.

The fixing unit 13 is for fixing the toner image transferred to the sheet in the image forming station 12. The fixing unit 13 includes a heating roller 131 internally provided with an electric heating element such as a halogen lamp as a heating source, a fixing roller 132 arranged to face this heating roller 131, a fixing belt 133 mounted between this fixing roller 132 and the heating roller 131, and a pressure roller 134 arranged to face this fixing belt 133 and the fixing roller 132.

The sheet P bearing the completely fixed color image passes through a sheet discharging path 114 extending from a side above the fixing unit 13 and is discharged toward a discharge tray 115 provided on the left wall of the apparatus body 11.

The sheet storing unit 14 includes sheet trays 141 detachably mounted below the image forming station 12 in the apparatus body 11 and adapted to store stacks of sheets P. Although the sheet trays 141 are arranged in two levels in an example shown in FIG. 1, they may be arranged in three or more levels or in one level.

Sheets P are dispensed one by one from the stack of sheets stored in the sheet tray 141 by driving a pickup roller 142. The dispensed sheet P is fed to a nip between the secondary transfer roller 113 and the transfer belt 125 of the image forming station 12 via the sheet path 111 and has a color toner image formed on the outer surface of the transfer belt 125 transferred thereto. The movement of the sheet P after the transfer process is noted above.

Figure 2:
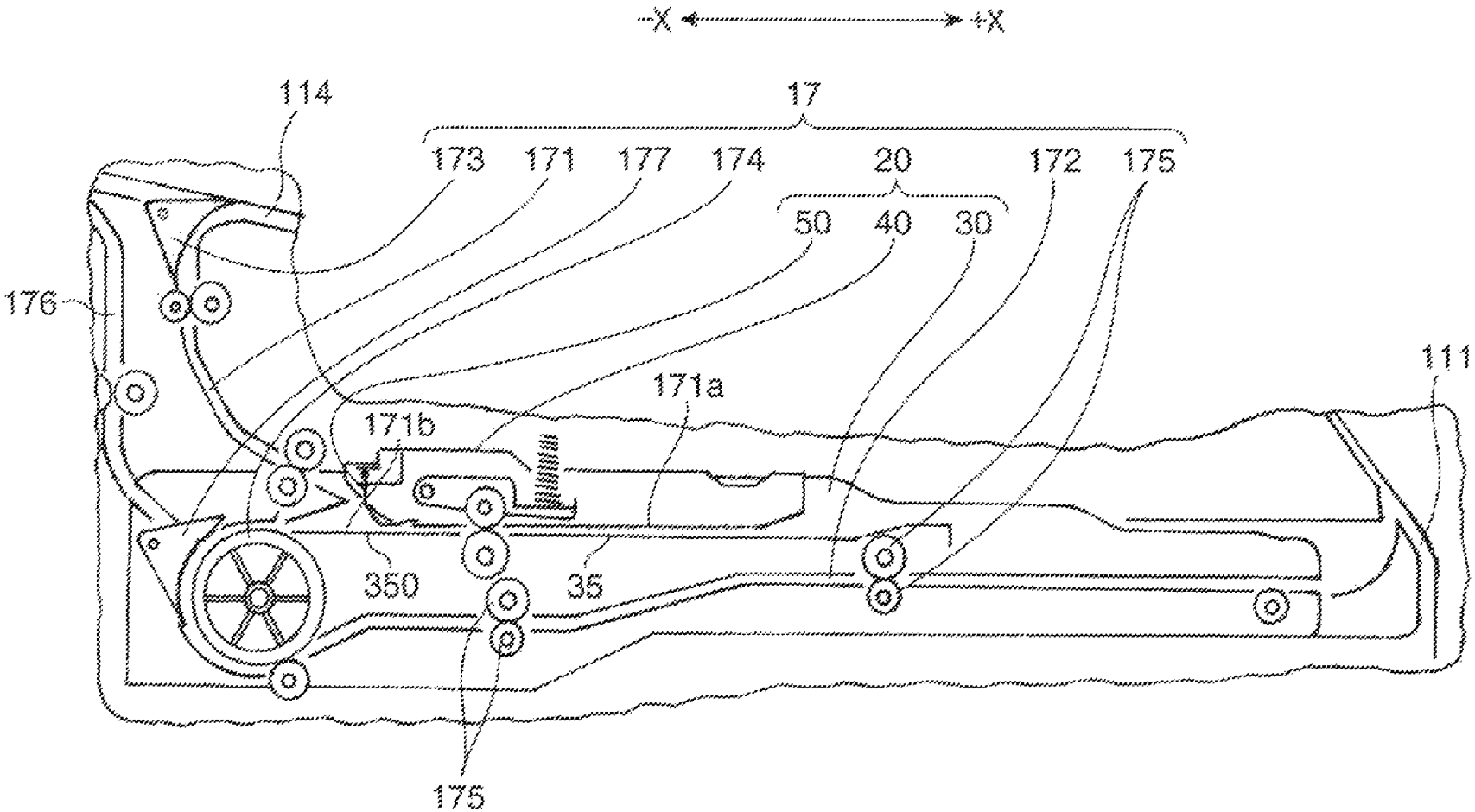
FIG. 2 is a diagram enlargedly showing a part of a sheet reversing unit of FIG. 1.

In the image forming apparatus 10 constructed as above, a sheet reversing unit 17 used to print both sides of a sheet P is provided between the image forming station 12 and the sheet storing unit 14 in this embodiment. The sheet reversing unit 17 is described below with reference to FIG. 2 and, if necessary, other figures. FIG. 2 is a partial enlarged view of FIG. 1 showing the sheet reversing unit 17 including a sheet reversing unit 20. Direction indication by X in FIG. 2 is same as in the case of FIG. 1 (−X: leftward, +X: rightward).

As shown in FIG. 2, the sheet reversing unit 17 includes a reversing tray conveyance path (first conveyance path) 171, the sheet reversing unit 20 (sheet reversing device) and a sheet refeeding path 172. The reversing tray conveyance path 171 is a vertical conveyance path formed right downstream of the fixing unit 13 and branched off downward from the sheet discharging path 114. The sheet reversing unit 20 includes a reversing tray 35 continuous with a downstream end of the reversing tray conveyance path 171 and adapted to switch back the sheet P. The sheet refeeding path 172 is a conveyance path for refeeding the switched back sheet P toward the image forming station 12 after the sheet P is carried into the sheet reversing unit 20.

A switchback conveyance path (second conveyance path) 171*a* is formed above the reversing tray 35. The switchback conveyance path 171*a* is a horizontally extending conveyance path for switching back the sheet P carried in via the reversing tray conveyance path 171 and carrying this sheet P out. An intermediate conveyance path (third conveyance path) 171*b* s formed between the switchback conveyance path 171*a* and the sheet refeeding path 172. The intermediate conveyance path 171*b* is for receiving the sheet P carried out from the switchback conveyance path 171*a* and conveying it to the sheet refeeding path 172.

A first switching guide 173 is disposed at a branched position of the reversing tray conveyance path 171 and the sheet discharging path 114. This first switching guide 173 is rotated in forward and reverse directions about a horizontal shaft to switch a conveyance end between the discharge tray 115 and the reversing tray conveyance path 171.

In the case of selecting duplex printing, a sheet P having a toner image transferred to one side thereof fixed in the fixing unit 13 passes through the reversing tray conveyance path 171 via the first switching guide 173 switched toward the reversing tray conveyance path 171 and is carried into the sheet reversing unit 20. The sheet P carried into the sheet reversing unit 20 is subsequently carried out from the sheet reversing unit 20 and fed in the reverse direction toward the image forming station 12 along the sheet refeeding path 172. The sheet P supplied to the image forming station 12 while being turned upside down has a printing process applied to the other side thereof. The sheet P having the both sides printed is discharged to the discharge tray 115 this time via the first switching guide 173 whose posture is changed to convey the sheet P toward the sheet discharging path 114 after a fixing process is applied in the fixing unit 13.

The sheet refeeding path 172 is provided in the sheet reversing unit 20 in this embodiment. A large-diameter conveyor roller 174 is arranged upstream of the sheet refeeding path 172 and below and slightly to the left of a downstream end of the reversing tray conveyance path 171. The sheet refeeding path 172 extends rightward from a lower part of the circumferential surface of the large-diameter conveyor roller 174, and a downstream end thereof is connected to the sheet conveyance path 111. A plurality of reversing roller pairs 175 are disposed in the sheet refeeding path 172.

A sheet emergency discharging path 176, which extends upward from an upstream end of the sheet refeeding path 172 and joins the sheet discharging path 114, is formed to the left of the reversing tray conveyance path 171. A second switching guide 177 is disposed at a branched position of the sheet emergency discharging path 176 and the sheet refeeding path 172. If a certain trouble occurs to the sheet carried into the sheet reversing unit 20, the sheet P is discharged to the discharge tray 115 through the sheet emergency discharging path 176 and the sheet discharging path 114 via the second switching guide 177.

Figure 3:
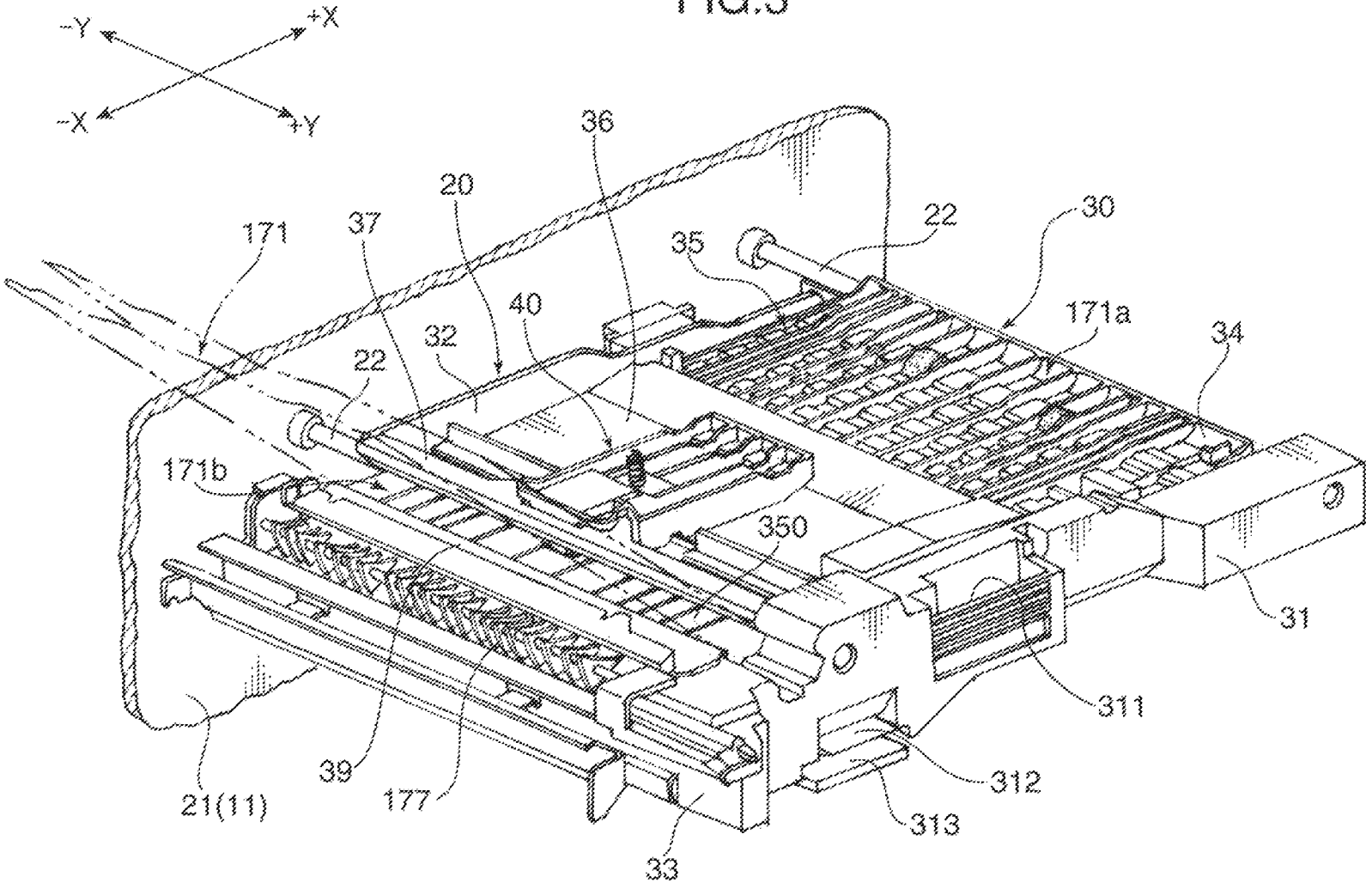
FIG. 3 is a perspective view of the sheet reversing unit.

The sheet reversing unit 20 is described in detail below with reference to FIG. 3. FIG. 3 is a perspective view showing one embodiment of the sheet reversing unit 20. In FIG. 3, X directions are referred to as lateral directions and Y directions are referred to as forward and backward directions and particularly −X direction is leftward direction; +X direction is rightward direction; −Y direction is forward direction; and +Y is backward directions.

Figure 4:
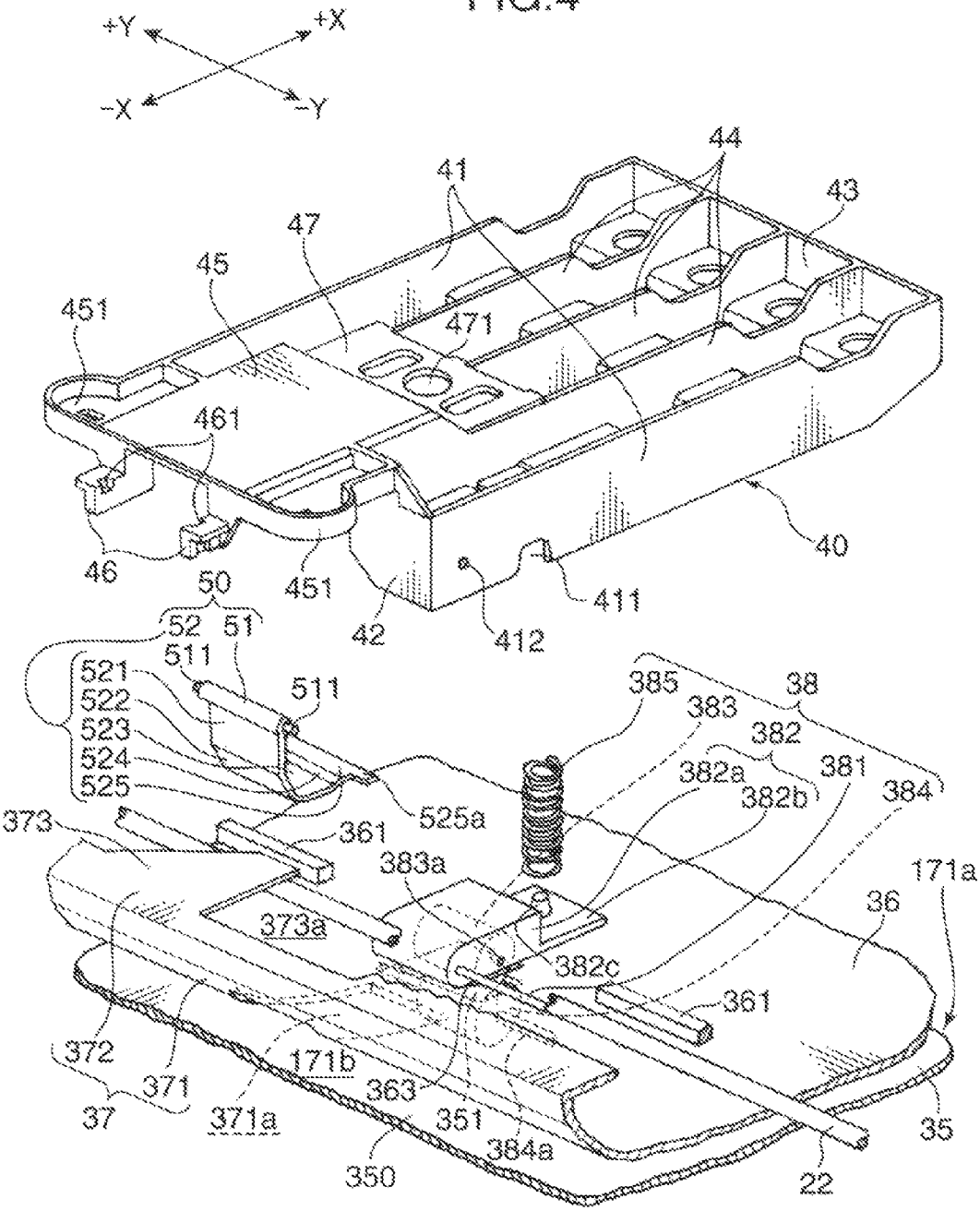
FIG. 4 is an exploded perspective view of a small frame body attached to the sheet reversing unit.

The sheet reversing unit 20 includes a unit frame body 30, a small frame body 40 and a pivotal guide member 50 (FIG. 4). The unit frame body 30 has a front-and-rear dimension and a lateral dimension respectively slightly shorter than a front-and-rear inner dimension and a lateral inner dimension of the apparatus body 11 of the image forming apparatus 10 and has a rectangular shape in a plan view. The small frame body 40 is a flat member to be mounted on the upper surface of the unit frame body 30 and having a planar shape considerably smaller than the unit frame body 30. The pivotal guide member 50 is pivotably attached to the left edge of the small frame body 40 for guiding the leading end of a sheet P in a moving direction.

The unit frame body 30 includes a front wall member 31 long in the lateral direction, a rear wall 32 arranged at a rear side to face the front wall member 31, a left wall member 33 extending between the left edges of the front wall member 31 and the rear wall 32 and a right wall 34 extending between the right edges of the front wall member 31 and the rear wall 32. The reversing tray 35 as a constituent element of the switchback conveyance path 171*a* extends between the upper edges of these respective walls except the front wall member 31, i.e. between the rear wall 32, the left wall member 33 and the right wall member 34.

The unit frame body 30 further includes a left plate 36 and a U-shaped plate 37. The left plate 36 extends between the front wall member 31 and the rear wall 32 at a position slightly above a substantially left half of the reversing tray 35. The U-shaped plate 37 has a U-shaped cross section with a lateral opening and extends toward a left-upper side from the left edge of the left plate 36 and the leading end side thereof is bent toward the right. An intermediate plate 350 is provided to the left of the reversing tray 35 via a conveying mechanism 38 to be described later. The intermediate plate 350 is a horizontally extending constituent element of the intermediate conveyance path 171*b* for passing the sheet P on toward the sheet refeeding path 172.

The U-shaped plate 37 includes an inclined guiding plate (curved guide plate) 371 and a small-frame-body catching plate (supporting plate) 372. The inclined guiding plate 371 has a curved guide surface formed to have a curved cross section and extend from the left edge of the left plate 36 toward the left-upper side, and guides the sheet P to the reversing tray 35. The small-frame-body catching plate 372 extends rightward from the inclined guiding plate 371 above the curved guide surface and catches the left end of the small frame body 40.

An extending plate 39 extending between the left ends of the front wall member 31 and the rear wall 32 is provided above and right to the right of the second switching guide 177. The sheet P carried into the switchback conveyance path 171*a* on the reversing tray 35 passes through the intermediate conveyance path 171*b* formed between the underside of the extending plate 39 and the intermediate plate 350 and heads for the sheet refeeding path 172 via the second switching guide 177 upon being fed in the reverse direction from the switchback conveyance path 171*a*.

The sheet reversing unit 20 for switching back and conveying the sheet P in this way is slidably mounted on a pair of guide rods 22 extending in the lateral direction in the apparatus main body 11, and is mountable into and detachable from the apparatus main body 11 while being guided by this pair of guide rods 22. The pair of guide rods 22 project forward from a frame plate 21 arranged at the rear side in the apparatus main body 11 and slidably penetrate through the opposite left and right ends of the front wall member 31 and the rear wall 32 of the unit frame body 30.

A grip 311 is provided substantially in a central part of the front surface of the front wall member 31. A lock portion 312 for locking the unit frame body 30 so as not to move and an operable piece 313 for unlocking the unit frame body 30 are provided to the left of the grip 311. When a user inserts or detaches the sheet reversing unit 20 into or from the apparatus main body 11, he or she can easily insert or detach the sheet reversing unit 20 by holding the grip 311 with his or her right hand while operating the lock portion 312 with his or her left hand.

Figure 5:
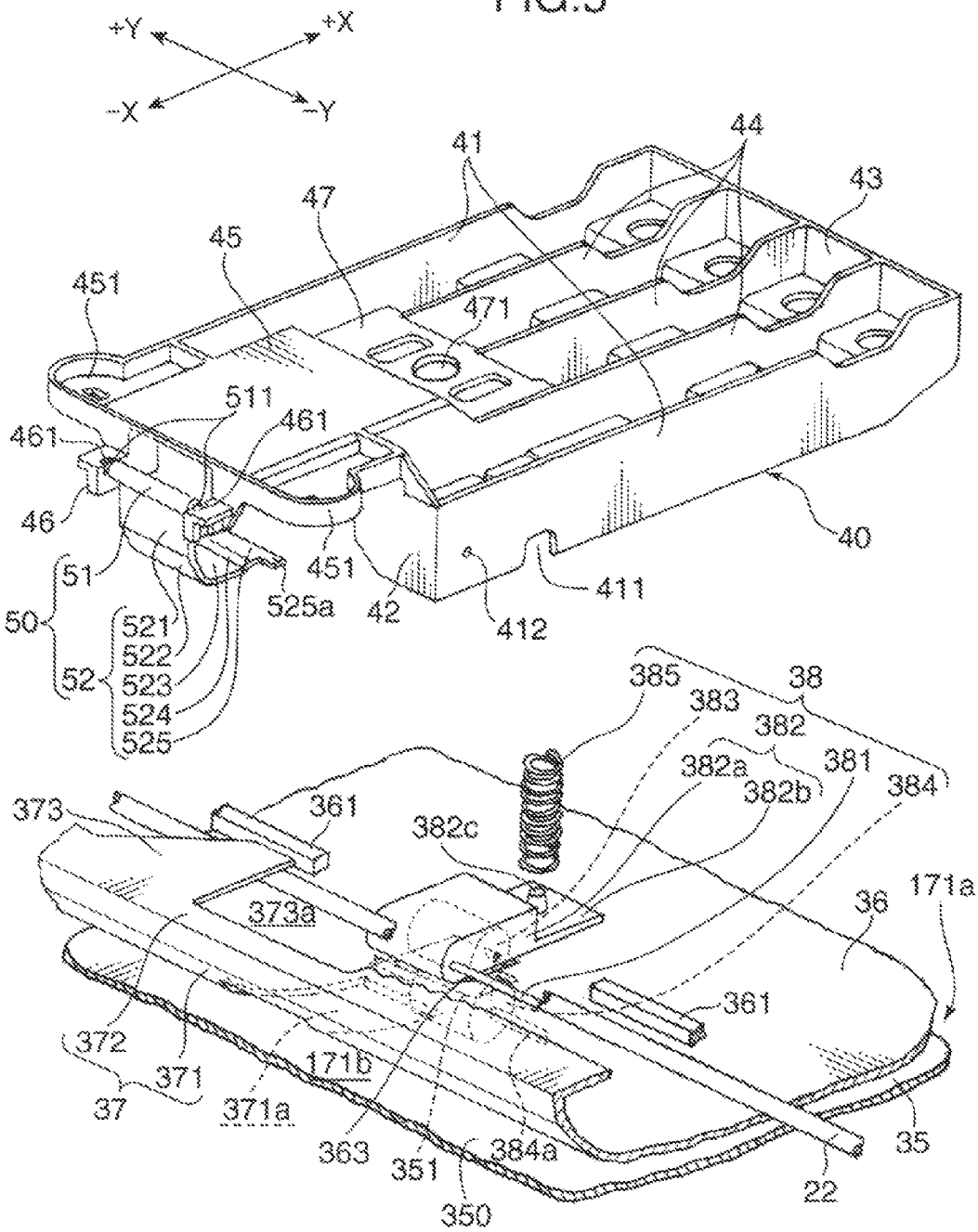
FIG. 5 is an exploded perspective view showing a state where a pivotal guide member is attached to the small frame body.
Figure 6:
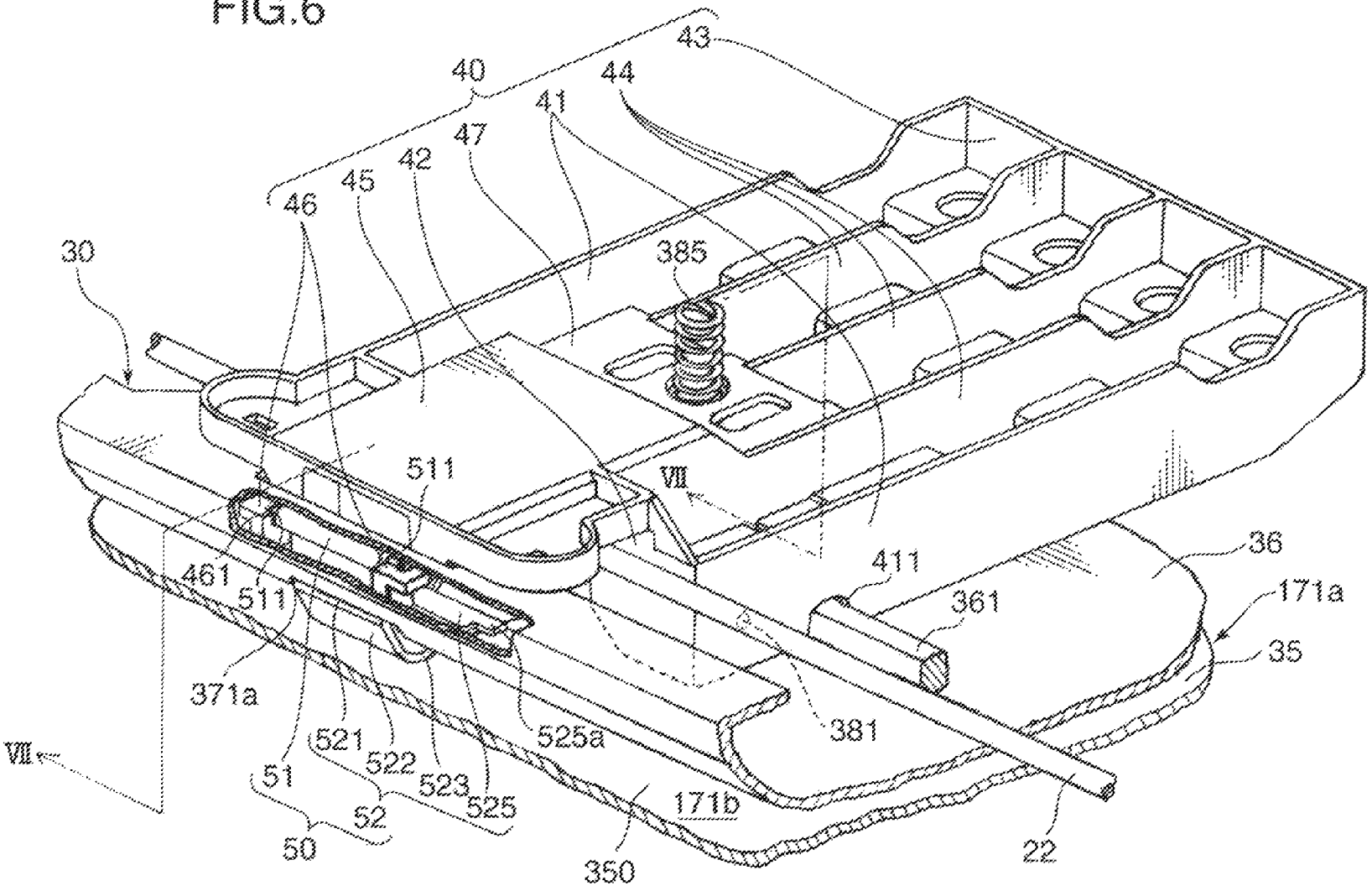
FIG. 6 is an assembled perspective view showing a state where the small frame body shown in FIG. 5 is attached to a unit frame body.
Figure 7:
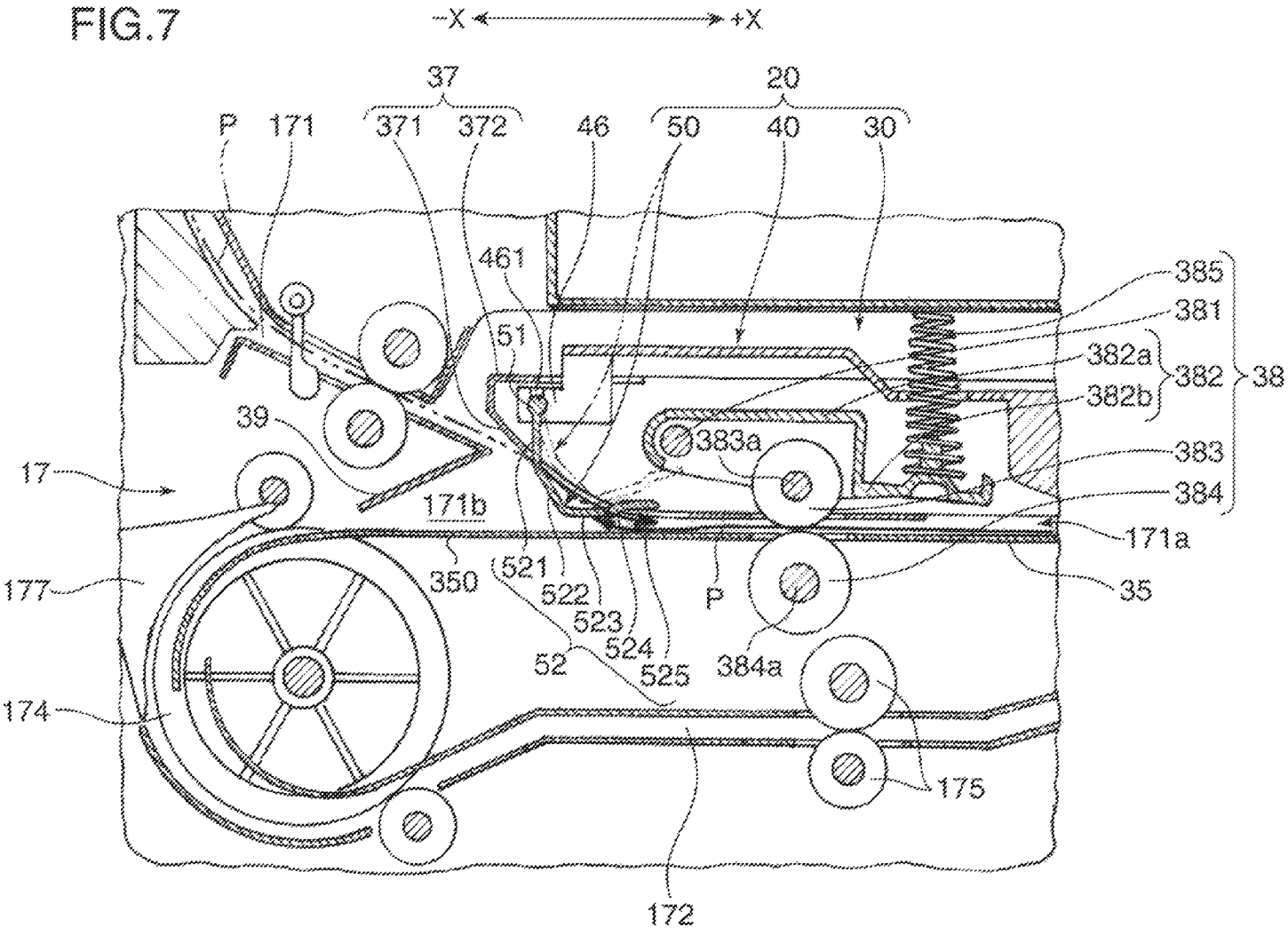
FIG. 7 is a section along VII-VII of FIG. 6, FIGS. 8A to 8C and 9A to 9C are action diagrams showing the action of the pivotal guide member 50.

The small frame body 40 is described in detail below with reference to FIGS. 4 to 7. FIGS. 4 to 7 show the small frame body 40 to be attached to the sheet reversing unit 20, wherein FIG. 4 is a perspective view, FIG. 5 is a perspective view showing a state where the pivotal guide member 50 is attached to the small frame body 40, FIG. 6 is an assembled perspective view partly cut away, and FIG. 7 is a section along VII-VII of FIG. 6. Direction indication by X and Y in FIGS. 4 to 7 is same as in the case of FIG. 3 (−X: leftward, +X: rightward, −Y: forward, +Y: backward).

As shown in FIG. 4, the pivotal guide member 50 is pivotably attached to the small frame body 40 and fixed to the left plate 36 of the unit frame body 30 by means of screws or another method. The small frame body 40 includes a pair of front and rear plates 41, a left plate 42 extending between the left edges of the pair of front and rear plates 41, a right plate 43 extending between the right edges of the pair of front and rear plates 41, a plurality of reinforcing ribs 44 extending in the lateral direction and arranged at equal intervals in parallel with each other between the left and right plates 42, 43, and an overhanging plate 45 projecting slightly upward from the upper edge of the left plate 42 and extending in the lateral direction.

A central part of the left plate 42 in forward and backward directions projects upward so as to be located slightly above the upper edges of the front and rear plates 41. A part of the overhanging plate 45 projecting leftward from the left plate 42 includes bulging portions 451 bulging out forward and backward.

Pivotal guide supporting arms 46 (supporting members) project leftward from the left edge of the overhang plate 45 at symmetrical positions spaced apart by a specified distance in forward and backward directions and located slightly below. A spacing between this pair of pivotal guide supporting arms 46 is slightly larger than a front-and-rear dimension of the pivotal guide member 50. Facing surfaces of the pair of pivotal guide supporting arms 46 are cut off at their upper corners, thereby forming supporting grooves 461 for supporting cylindrical small pieces 511 of a later-described pivot axis 51 of the pivotal guide member 50 fitted thereinto.

A crossing plate 47 crossing over the plurality of (three in an example shown in FIG. 4) reinforcing ribs 44 in forward and backward directions is provided to the right of the right end of the overhang plate 45. An insertion hole 471 for permitting the insertion of a coil spring 385 for applying a biasing force to an upper conveyor roller 383 of the conveying mechanism 38 to be described later is formed to penetrate a central part of the crossing plate 47.

Cuts are made upward from the bottom edges in the pair of front and rear plates 41 of the small frame body 40 at positions facing each other in forward and backward directions, thereby forming positioning grooves 411. The positioning grooves 411 are engaged with positioning projections 361 to be described later provided on the left plate 36 of the unit frame body 30.

The small frame body 40 includes reinforcing small pieces between the front and rear plates 41 and the reinforcing ribs 44 and between adjacent reinforcing ribs 44. On the other hand, the small frame body 40 includes no ceiling plate and no bottom plate.

The left plate 36 of the unit frame body 30, to which the small frame body 40 is to be attached, is provided with the positioning projections 361 extending in forward and backward directions. The positioning grooves 411 of the pair of front and rear plates 41 of the small frame body 40 are engaged with these positioning projections 361 to position the small frame body 40 on the left plate 36 in forward and backward directions.

The small-frame-body catching plate 372 (supporting plate) of the U-shaped plate 37 formed at the left end of the unit frame body 30 is provided with a bulging portion 373 bulging out rightward toward the center in forward and backward directions. The bulging portion 373 is cut toward the left from the right edge to form a fitting recess 373*a*, into which the pair of pivotal guide supporting arms 46 of the small frame body 40 are fitted.

Further, the inclined guiding plate 371 is formed with a projecting window 371*a* for allowing a part of the pivotal guide member 50 suspended on the pivotal guide supporting arms 46 to project outward. The projecting window 371*a* has such a size as to allow the passage of a part of the pivotal guide member 50.

The conveying mechanism 38 for giving a conveying force to a sheet P being conveyed between the left plate 36 and the reversing tray 35 is provided at a position of the left plate 36 of the unit frame body 30 right below the crossing plate 47 of the small frame body 40.

The conveying mechanism 38 includes a supporting shaft 381 inserted and supported in supporting holes 412 formed in the pair of front and rear plates 41, a rotatable arm 382 supported rotatably about the supporting shaft 381 and extending rightward, the upper conveyor roller 383 supported concentrically with and rotatably about a roller shaft 383*a* penetrating the rotatable arm 382 in forward and backward directions, a lower conveyor roller 384 arranged below the reversing tray 35 while facing the upper conveyor roller 383, and the coil spring 385 for biasing and pressing the right end of the rotatable arm 382 downward.

The rotatable arm 382 includes a roller mounting portion 382*a* which is hollow and has an open lower surface and a substantially rectangular parallelepipedic shape, and a plate-like spring supporting portion 382*b* projecting rightward from the bottom edge of the right end of the roller mounting portion 382*a*. The spring supporting portion 382*b* includes a spring supporting projection 382*c* which projects upward and on which the coil spring 385 is mounted.

The upper conveyor roller 383 is rotatably supported on the supporting shaft 381 penetrating the opposite sides of the roller mounting portion 382*a* in forward and backward directions with a part thereof projecting outward through the lower opening of the roller mounting portion 382*a*. An upper roller window 363 for the upper conveyor roller 383 is formed at a position of the left plate 36 corresponding to the upper conveyor roller 383.

The lower conveyor roller 384 is concentrically and integrally rotatably mounted on a drive shaft 384*a* arranged in parallel with the roller shaft 383*a* below the reversing tray 35. The reversing tray 35 is formed with a lower roller window 351 at a position facing the upper roller window 363. The position of the lower conveyor roller 384 is so set that the circumferential surface of the lower conveyor roller 384 projects upward through the lower roller 351. The positions of the upper and lower conveyor rollers 383, 384 are so set that the circumferential surface of the lower conveyor roller 384 projecting upward from the lower roller window 351 is held in contact with the circumferential surface of the upper conveyor roller 383 rotatable clockwise about the supporting shaft 381.

The drive shaft 384*a* is rotatable in forward and backward directions by being driven by an unillustrated drive motor. A sheet P having reached a nip between the upper and lower conveyor rollers 383, 384 is conveyed toward the reversing tray 35 or conveyed backward from the reversing tray 35 depending on a rotating direction of the lower conveyor roller 384.

The coil spring 385 applies a biasing force to rotate the rotatable arm 382 clockwise about the supporting shaft 381. As shown in FIG. 7, the coil spring 385 is fitted on the spring supporting projection 382*c* and compressed between the spring supporting portion 382*b* of the rotatable arm 382 and a specified frame in the apparatus body 11. Thus, a biasing force is applied to the rotatable arm 38 to rotate it clockwise about the supporting shaft 381, with the result that the upper conveyor roller 383 presses the lower conveyor roller 384 with a biasing force of the coil spring 385 in addition to gravity. Therefore, the sheet P having reached the nip between the upper and lower conveyor rollers 383, 384 is more reliably conveyed by the rotation of these upper and lower conveyor rollers 383, 384.

The pivotal guide member 50 is pivotably supported on the left end of the small frame body 40 with a part thereof projecting from the curved guide surface of the inclined guiding plate 371. The pivotal guide member 50 is for smoothly guiding the sheet P from the reversing tray conveyance path 171 to the reversing tray 35 and smoothly guiding the sheet P once carried into the reversing tray 35 to the sheet refeeding path 172. The pivotal guide member 50 pivots to be retracted to the inner side of the curved guide surface by being pushed by the sheet P moving from the reversing tray conveyance path 171 to the reversing tray 35 (switchback conveyance path 171*a*). On the other hand, the sheet switched back and carried out from the reversing tray 35 is guided toward the intermediate conveyance path 171*b* with the part of the pivotal guide member 50 projecting from the curved guide surface.

The pivotal guide member 50 is provided for the following reason. Specifically, a sheet P having a toner image transferred to one side thereof from the photoconductive drums 121 of the image forming station 12 is successively subjected to a fixing process by heating in the fixing unit 13. At this time, the upper side of the sheet P horizontally moving is heated by the fixing belt 133. A thermal expansion amount of the upper side (i.e. top side) of the sheet P at this point of time is larger than that of the under side. Accordingly, the opposite ends of the sheet P discharged from the fixing unit 13 in the moving direction are arcuately curved from the top side toward the under side due to a difference in this thermal expansion amount, thereby forming so-called downward curls.

The sheet formed with the curls moves downward through the reversing tray conveyance path 171 and is carried into the reversing tray 35 of the sheet reversing unit 20. The sheet is already turned upside down when being carried into the reversing tray 35. Thus, the sheet P on the reversing tray 35 is formed with upward curls curved upward at the opposite ends of the upper side (i.e. under side).

Accordingly, upon discharging the sheet P formed with the upward curls at the ends to the left from the reversing tray 35, the upward curl interferes with the bottom end of the left wall surface of the reversing tray conveyance path 171. As a result, this sheet P may be fed to the reversing tray conveyance path 171 instead of moving to the sheet refeeding path 172. If the sheet P carried out from the reversing tray 35 moves to the reversing tray conveyance path 171 without moving to the sheet refeeding path 172, not only a printing process cannot be applied to the other side of the sheet P, but also this sheet may be jammed in the reversing tray conveyance path 171.

Thus, in this embodiment, the pivotal guide member 50 is pivotably mounted on the left end of the small frame body 40, and the sheet P from the reversing tray conveyance path 171 can be smoothly carried into the reversing tray 35 and the sheet P is prevented from moving to the reversing tray conveyance path 171 upon being carried out from the reversing tray 35 by the action of this pivotal guide member 50.

As shown in FIG. 4, the pivotal guide member 50 includes the pivot shaft 51 extending in forward and backward directions and a curved guide plate 52 extending downward from the circumferential surface of the pivot shaft 51.

The length of the pivot shaft 51 is set to be slightly shorter than an inner dimension between the pair of pivotal guide supporting arms 46 of the small frame body 40. The cylindrical small pieces (swing pivot) 511 concentrically project in opposite directions from the opposite end surfaces of the pivot shaft 51. As shown in FIG. 5, these cylindrical small pieces 511 are fitted and supported in the supporting grooves 461 formed in the pair of pivotal guide supporting arms 46, whereby the pivotal guide member 50 can pivot about the cylindrical small pieces 511.

The curved guide plate 52 includes a hanging portion 521 hanging down from the pivot shaft 51, an inclined portion (interfering portion) 522 extending obliquely downward toward the right from the bottom end of the hanging portion 521, a horizontal portion 523 extending substantially horizontally to the right from the bottom end of the inclined portion 522, a stepped portion (upwardly inclined portion) 524 inclined from the leading end of horizontal portion 523 slightly upward toward the right to form a step, and a leading-end plate portion (leading end portion) 525 long in forward and backward directions and extending substantially horizontally to the right from the leading end of the stepped portion 524. The above inclined portion 522 and horizontal portion 523 are parts projecting from the curved guide surface of the inclined guiding plate 371 when the pivotal guide member 50 is in a stationary state. The inclined portion 522 interferes with the leading end of a sheet P moving from the reversing tray conveyance path 171 toward the switchback conveyance path 171*a*.

The hanging portion 521, the inclined portion 522, the horizontal portion 523 and the stepped portion 524 are all set to have the same width in forward and backward directions, whereas a dimension of the leading-end plate portion 525 in forward and backward directions is set to be longer than these widths. Parts of the leading-end plate portion 525 projecting forward and backward serve as locking projecting pieces (stoppers; a part of the leading end portion that interferes with an edge portion of a window) 525*a*.

A part of the curved guide plate 52 excluding the leading-end plate portion 525 is set to have a width in forward and backward directions slightly shorter than an inner dimension in forward and backward directions of the projecting window 371*a* formed in the inclined guiding plate 371 at the left end of the unit frame body 30. Accordingly, with the small frame body 40 attached to the unit frame body 30, the pivotal guide member 50 hanging down from the pivotal guide supporting arms 46 of the small frame body 40 is in such a state that the hanging portion 521, the inclined portion 522 and the horizontal portion 523 project downward toward the left from the projecting window 371*a* of the unit frame body 30 as shown in FIG. 6.

At this time, the locking projecting pieces 525*a* of the curved guide plate 52 rest on the inclined guiding plate 371 forming front and rear edge portions (edge portion of the window) of the projecting window 371*a* as shown in FIG. 7. Accordingly, the pivotal guide member 50 is not rotated clockwise any further, the hanging portion 521 of the curved guide plate 52 is kept hanging down, the inclined portion 522 appropriately projects out from the projecting window 371*a* and the horizontal portion 523 is kept in its horizontal posture. In other words, the inclined portion 524 is a part which passes through the projecting window 371*a*, and the leading-end plate portion 525 is located on a surface of the inclined guiding plate 371 opposite to the curved guide surface through the projecting window 371*a*.

In FIG. 7, a sheet P moving toward the reversing tray 35 through the reversing tray conveyance path 171 and the curved guide plate 52 in such a state as to interfere with the leading edge of the sheet P at this time to be rotated counterclockwise about the pivot shaft 51 is shown in chain double-dashed line. On the contrary, the sheet P switched back and being carried out from the reversing tray 35 after being carried into the reversing tray 35 and a state of the curved guide plate 52 at this time are shown in solid line.

Figure 8A:
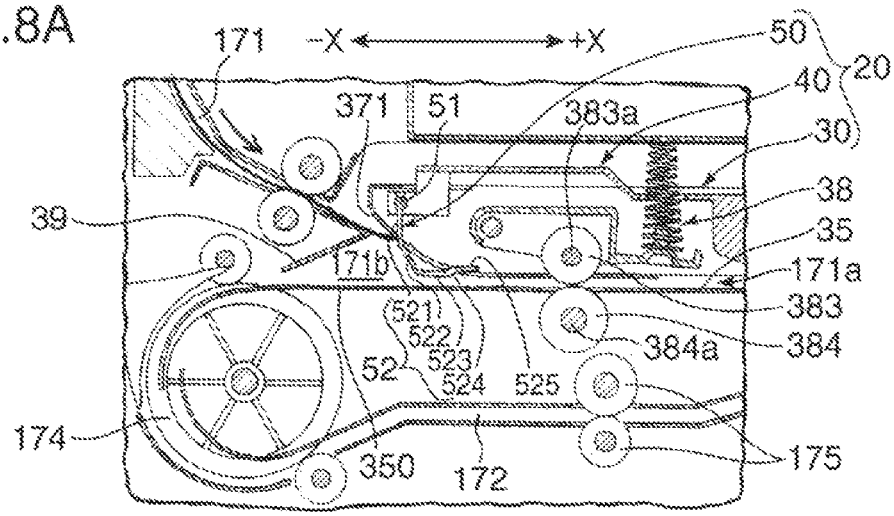

The action of the pivotal guide member 50 is described below with reference to FIGS. 8A to 9C. FIGS. 8A to 9C are action diagrams showing the action of the pivotal guide member 50, wherein FIGS. 8A to 8C show a state until the sheet P is carried into the reversing tray 35 and FIGS. 9A to 9C shows a state where the sheet P carried into the reversing tray 35 is switched back and pulled out.

Figure 8B:
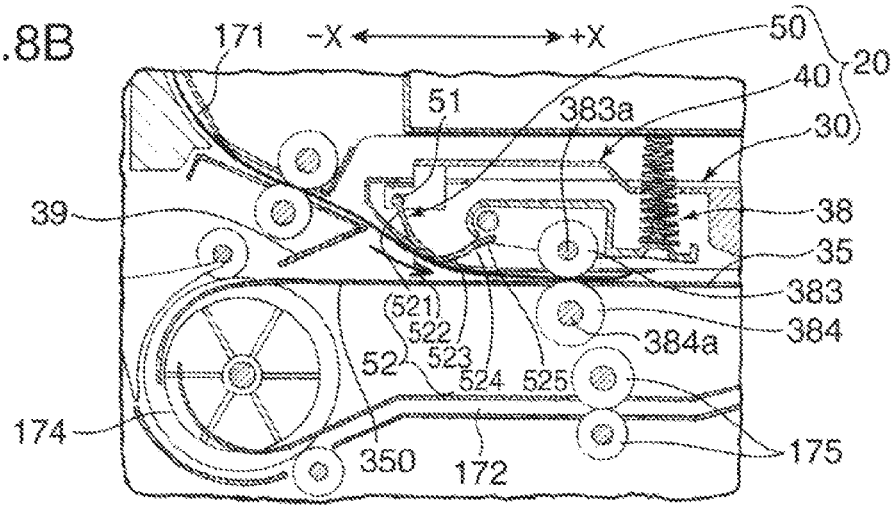
Figure 8C:
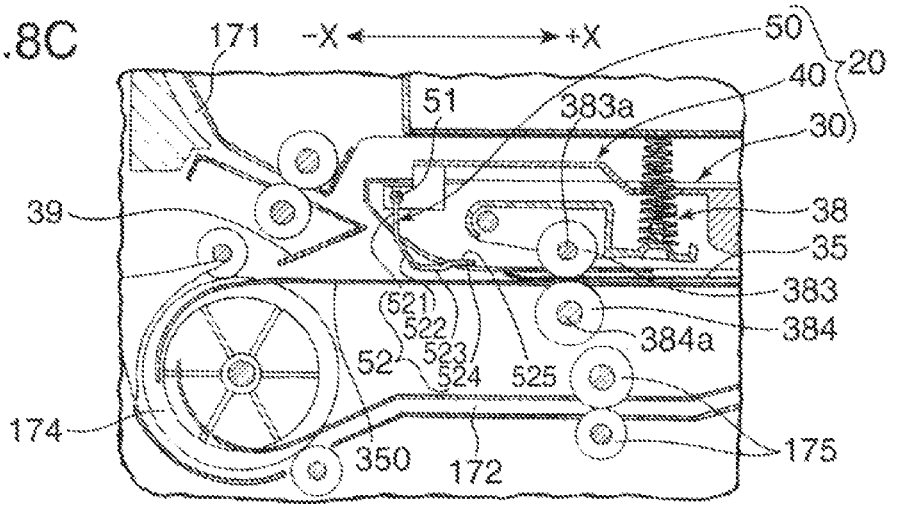
Figure 9A:
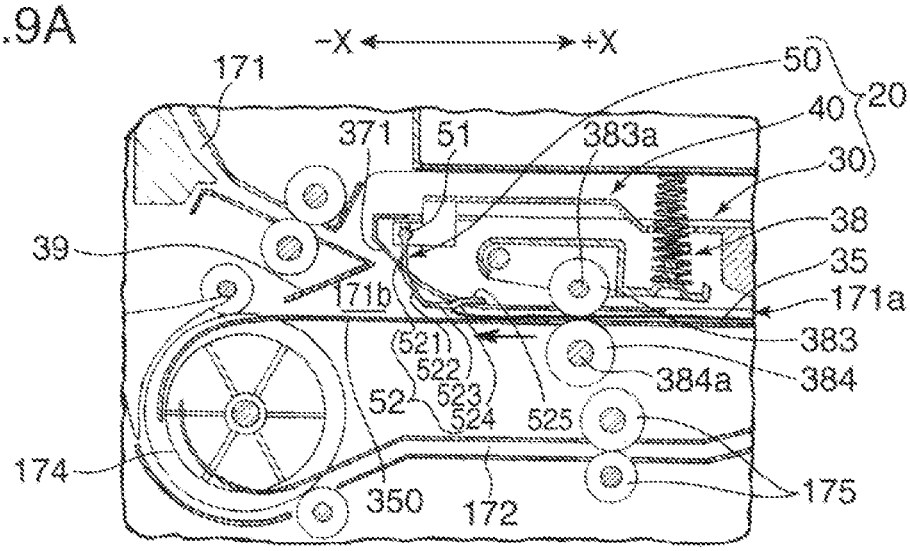
Figure 9B:
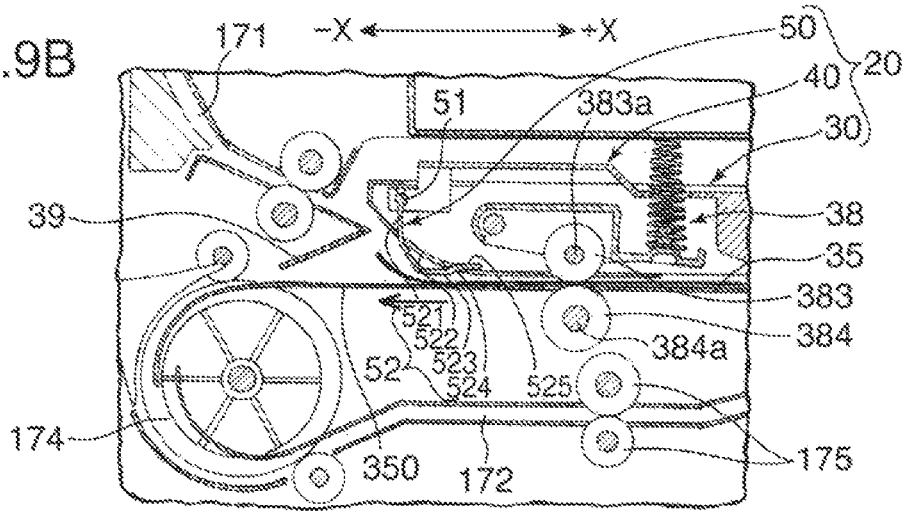
Figure 9C:
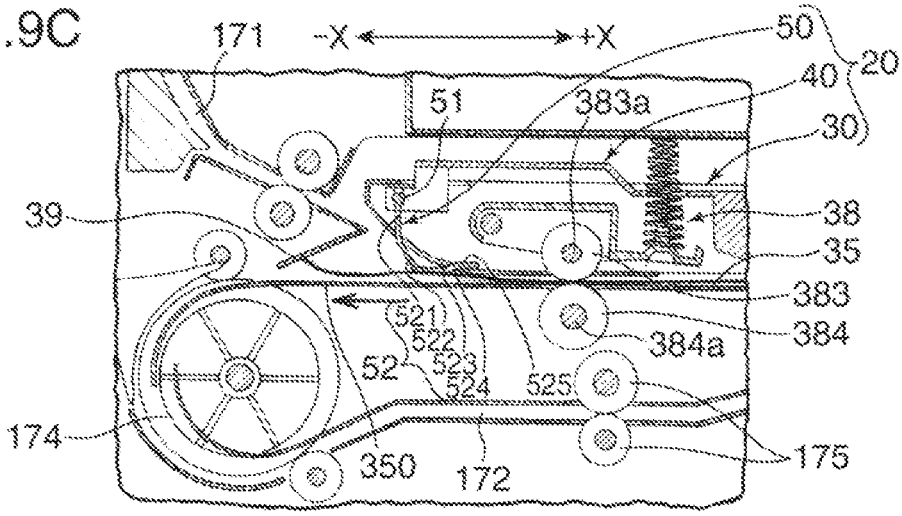
Figure 10A:
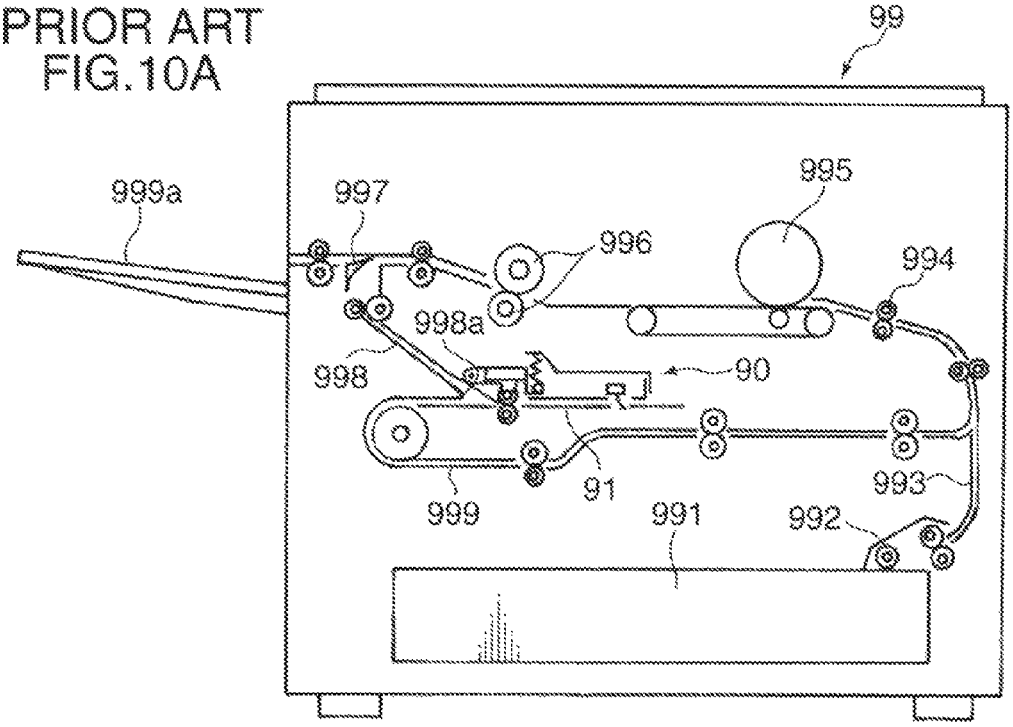
PRIOR ART FIG.10A
Figure 10B:
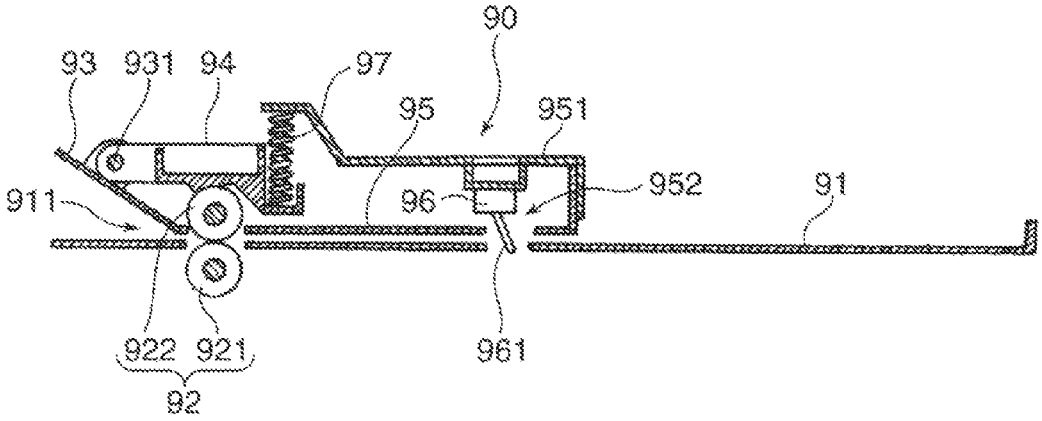
PRIOR ART FIG.10B

FIG. 8A shows a state where the sheet P is conveyed to a position immediately before the entrance of the reversing tray 35 of the sheet reversing unit 20, FIG. 8B shows a state where the sheet P is being carried into the reversing tray 35 and FIG. 8C shows a state where the sheet P is carried in the reversing tray 35. FIG. 9A shows a state where the sheet P is being carried out from the reversing tray 35 while the leading end thereof is sliding on the horizontal portion 523 of the curved guide plate 52, FIG. 9B shows a state immediately after the leading end of the sheet P leaves the curved guide plate 52 and FIG. 9C shows a state where the leading end of the sheet P is caught by the lower surface of the extending plate 39. Direction indication in FIGS. 8A to 9C is same as in the case of FIG. 7 (−X: leftward, +X: rightward).

As shown in FIG. 8A, the leading end of the sheet P fed to the reversing tray 35 of the sheet reversing unit 20 through the reversing tray conveyance path 171 moves obliquely downward toward the right while sliding on the inclined guiding plate 371 of the unit frame body 30, and slides on the inclined portion 522 after sliding on the hanging portion 521 of the curved guide plate 52.

The leading end of the sheet P slides on the hanging portion 521 and the inclined portion 522, whereby the pivotal guide member 50 is rotated counterclockwise about the pivot shaft 51. By this rotational movement, the pivotal guide member 50 is retracted from the guide surface of the inclined guiding plate 371. Thereafter, the sheet P is smoothly carried into the reversing tray 35 while the upper surface thereof slides on the curved guide plate 52 as shown in FIG. 8B.

Specifically, the sheet P having reached the nip between the upper and lower conveyor rollers 383, 384 is carried into the back part of the switchback conveyance path 171*a* on the reversing tray 35 by forward driving of the upper and lower conveyor rollers 383, 384 (counterclockwise rotation about the roller shaft 383*a* in the case of the upper conveyor roller 383 and clockwise rotation about the drive shaft 384*a* in the case of the lower conveyor roller 384). At this time, when the trailing end of the sheet P reaches a position immediately upstream of the nip between the upper and lower conveyor rollers 383, 384 as shown in FIG. 8C, this is detected by an unillustrated sensor.

Then, the upper and lower conveyor rollers 383, 384 are driven in reverse directions based on a detection signal of this sensor (clockwise rotation about the roller shaft 383*a* in the case of the upper conveyor roller 383 and counterclockwise rotation about the drive shaft 384*a* in the case of the lower conveyor roller 384). In this way, the sheet P is pulled out to the left from the reversing tray 35.

Here, the leading end (left end) of the sheet P is curved upward. Accordingly, the leading end surface of the sheet P first comes into contact with the right surface of the stepped portion 524 of the pivotal guide member 50 to press it to the left as shown in FIG. 9A, thereby trying to rotate the pivotal guide member 50 clockwise about the pivot shaft 51. However, since the locking projecting pieces 525*a* (see FIG. 6) of the pivotal guide member 50 rest on the front and rear edge portions of the projecting window 371*a* (i.e. parts of the inclined guiding plate 371), the pivotal guide member 50 is prevented from being rotated clockwise.

Subsequently, when the leading end of the sheet P reaches the horizontal portion 523 after passing the stepped portion 524, forces acting in two directions, i.e. an upward force by the curled leading end of the sheet P and a leftward force generated by a leftward movement of the sheet P are exerted on the horizontal portion 523. As a result, a force acting toward an left-upper side (force acting toward the pivot shaft 51) as a composition of these two forces is exerted on the horizontal portion 523. Accordingly, it becomes more difficult to rotate the pivotal guide member 50 counterclockwise about the pivot shaft 51, wherefore retraction of the curved guide plate 52 into the inside of the inclined guiding plate 371 is prevented.

When the sheet P is further carried out from the reversing tray 35 and the leading edge of the sheet P leaves the horizontal portion 523 of the pivotal guide member 50 as shown in FIG. 9B, the leading edge of the sheet P reaches the underside of the extending plate 39 as shown in FIG. 9C without colliding with the bottom end of the left wall surface of the reversing tray conveyance path 171. Thus, the sheet P carried into the switchback conveyance path 171*a* on the reversing tray 35 is prevented from moving toward the reversing tray conveyance path 171 when being carried out from the switchback conveyance path 171*a*.

As described in detail above, the sheet reversing unit 20 of this embodiment includes the reversing tray conveyance path 171, the reversing tray 35 for switching back the sheet P, the intermediate plate 350 for receiving and conveying the sheet P carried out from the reversing tray 35, the inclined guiding plate 371 having the curved guide surface for guiding the sheet P to the reversing tray 35 and the pivotal guide member 50 pivotably supported with the part thereof projecting from the curved guide surface.

The pivotal guide member 50 pivots to be retracted into the inner side of the curved guide surface of the inclined guiding plate 371 by being pushed by the sheet P moving from the reversing tray conveyance path 171 toward the reversing tray 35 while allowing the sheet P switched back and being carried out from the reversing tray 35 to move toward the intermediate conveyance path 171*b* on the intermediate plate 350.

According to the sheet reversing unit 20 constructed as above, the sheet P moving toward the reversing tray 35 through the reversing tray conveyance path 171 pushes the pivotal guide member 50 upon passing the inclined guiding plate 371 of the pivotal guide member 50 disposed between the reversing tray conveyance path 171 and the reversing tray 35. Thus, the pivotal guide member 50 pivots toward the inner side of the inclined guiding plate 371. Therefore, the sheet P can smoothly enter the horizontally extending reversing tray 35 while being guided by the curved guide surface of the inclined guiding plate 371.

On the other hand, when the sheet P carried into the reversing tray 35 is switched back and carried out, the pivotal guide member 50 guides the sheet P toward the intermediate plate 350 by a balance of the weight of the pivotal guide member 50 and a force that the horizontal portion 523 receives from the curled leading end of the sheet P. Thus, this sheet P is prevented from erroneously moving toward the vertically extending reversing tray conveyance path 171 and reliably guided to the horizontally extending intermediate plate 350. By such a guiding action of the pivotal guide member 50, a switchback structure for the sheet P can be made quite simple.

The pivotal guide member 50 is formed with the inclined portion 522 with which the leading end of the sheet P moving from the reversing tray conveyance path 171 toward the reversing tray 35 interferes, and the horizontal portion 523 extending horizontally from the bottom end of the inclined portion 522 toward the reversing tray 35.

By such an arrangement, the sheet P fed to the reversing tray 35 through the reversing tray conveyance path 171 interferes with the inclined portion 522 of the pivotal guide member 50, thereby being able to retract the pivotal guide member 50 into the inside of the inclined guiding plate 371. Thereafter, the sheet P is smoothly carried into the reversing tray 35 along the curved guide surface of the inclined guiding plate 371.

On the other hand, the sheet P switched back and being carried out after being carried into the reversing tray 35 is conveyed toward the horizontally extending intermediate plate 350 while being guided by the horizontal portion 523 of the pivotal guide member 50. Thus, a movement of the sheet P carried out from the reversing tray 35 toward the reversing tray conveyance path 171 can be reliably prevented.

The pivotal guide member 50 is suspended on the pivotal guide supporting arms 46 of the small frame body 40. Thus, if the trailing end of the sheet P leaves the inclined portion 522 of the pivotal guide member 50 when the sheet P is moving from the reversing tray conveyance path 171 toward the reversing tray 35, the pivotal guide member 50 can quickly pivot to return to its initial posture. Therefore, the sheet reversing unit 20 can deal with an increase in the conveying speed of the sheet P.

Further, the pivotal guide member 50 includes the locking projecting pieces 525*a* for preventing a pivotal movement of the pivotal guide member 50 toward the reversing tray conveyance path 171 by the interference with the parts of the inclined guiding plate 371. Thus, it can be effectively prevented that the pivotal guide member 50 pivotably disposed on the inclined guiding plate 371 unnecessarily pivots toward the reversing tray conveyance path 171 to thereby make the conveyance of the sheet P via the pivotal guide member 50 unstable.

In the image forming apparatus 10 according to this embodiment, such a sheet reversing unit 20 is used in a part for reversing the sheet P upon printing both sides of a sheet P. Thus, the sheet P having the printing process completed for one side can be quickly reversed in a stable state to apply the printing process to the other side, wherefore speeding-up of the image forming process can be dealt with.

The present invention is not limited to the above embodiment and also includes the following contents.

(1) In the above embodiment, the copier for color printing is taken as an example of the image forming apparatus 10 employing the sheet reversing unit 20. The image forming apparatus is not limited to the copier for color printing, and may be a copier for black-and-white printing. Further, the image forming apparatus is not limited to the copier and may be a printer having image information input from outside or a so-called facsimile machine having image information input and output via a communication line.

(2) In the above embodiment, the small frame body 40 having the pivotal guide member 50 attached thereto is attached to the unit frame body 30, whereby the pivotal guide member 50 is provided in the sheet reversing unit 20. However, the pivotal guide member 50 may be directly attached to the unit frame body 30 without via the small frame body 40.

(3) In the above embodiment, the pivotal guide member 50 is suspended on the pivotal guide supporting arms 46 of the small frame body 40. Instead of being suspended, a horizontal shaft may be provided at a suitable position of the inclined guiding plate 371 of the unit frame body 30 and the bottom end of the pivotal guide member 50 may be supported rotatably about this horizontal shaft.

The above specific embodiment mainly includes inventions having the following constructions.

A sheet reversing device according to one aspect of the present invention comprises a first conveyance path that extends vertically; a second conveyance path that extends horizontally, into which a sheet is carried via the first conveyance path and from which the sheet is carried out after being switched back; a third conveyance path that extends horizontally, receives and conveys the sheet carried out from the second conveyance path; a curved guide plate disposed between the first and second conveyance paths and including a curved guide surface for guiding the sheet to the second conveyance path; and a pivotal guide member pivotably supported with a part thereof projecting from the curved guide surface, wherein the pivotal guide member pivots to be retracted into the inner side of the curved guide surface by being pushed by the sheet moving from the first conveyance path toward the second conveyance path while guiding the sheet switched back and carried out from the second conveyance path toward the third conveyance path with the part thereof projecting from the curved guide surface.

According to the thus constructed sheet reversing device, the sheet moving from the second conveyance path through the first conveyance path presses the pivotal guide member upon passing the curved guide surface of the curved guide plate disposed between the first and second conveyance paths. Thus, the pivotal guide member pivots to be retracted into the inner side of the curved guide surface. Therefore, the sheet is smoothly carried into the horizontally extending second conveyance path while being guided by the curved guide surface of the curved guide plate.

On the other hand, upon switching back and carrying out the sheet carried into the second conveyance path, the pivotal guide member returns to its initial position and guides the sheet toward the third conveyance path with the part thereof projecting outward from the curved guide surface. Thus, this sheet is guided to the horizontally extending third conveyance path without erroneously moving toward the vertically extending first conveyance path. In this way, by quite a simple construction, it is possible to prevent the sheet from moving toward the first conveyance path at the time of switching back the sheet carried into the second conveyance path while suppressing a cost increase of the device.

In the above construction, it is preferable to further comprise a supporting member for suspending the pivotal guide member at a swing pivot of the pivotal guide member. According to this construction, a pivot structure for pivoting the pivotal guide member becomes simpler, which contributes to a reduction in the cost of the device.

In this case, it is preferable that the supporting member is arranged above the curved guide surface; that the curved guide surface includes a window for allowing the passage of the pivotal guide member; and that the pivotal guide member is suspended on the supporting member with a part thereof projecting from the window in a stationary state. According to this construction, the pivotal guide member can easily project from the curved guide surface and be retracted into the inner side of the curved guide surface.

In the above construction, it is preferable that the curved guide plate includes a supporting plate portion above the curved guide surface; and that the supporting member is supported by the supporting plate portion. According to this construction, since the member of the curved guide plate supports the supporting member, the number of parts can be reduced.

In the above construction, it is preferable that the pivotal guide member includes an interfering portion with which the leading end of the sheet moving from the first conveyance path toward the second conveyance path interferes and a horizontal portion extending horizontally from the bottom end of the interfering position toward the second conveyance path; and that the interfering portion and the horizontal portion constitute the part projecting from the curved guide surface.

According to this construction, the sheet to be fed to the second conveyance path though the first conveyance path interferes with the interfering portion of the pivotal guide member, whereby the pivotal guide member can be retracted into the inside of the curved guide plate. Thus, the sheet is, thereafter, smoothly carried into the second conveyance path along the curved guide surface of the curved guide plate. On the other hand, the sheet switched back and being carried out after being carried into the second conveyance path is conveyed toward the third conveyance path while being guided by the horizontal portion of the pivotal guide member, wherefore a movement of the sheet toward the vertically extending first conveyance path is reliably prevented. Further, since the pivotal guide member is suspended, if the trailing end of the sheet leaves the interfering portion of the pivotal guide member upon moving from the first conveyance path toward the second conveyance path, the pivotal guide member can quickly pivots to return to its initial posture. Therefore, the sheet reversing device can deal with an increase in the conveying speed of the sheet.

In the above construction, the pivotal guide member preferably includes a stopper for preventing a pivotal movement of the pivotal guide member toward the first conveyance path by the interference with a part of the curved guide plate. According to this construction, an unnecessary pivotal movement of the pivotal guide member toward the first conveyance path is inhibited and the sheet can be stably conveyed via the pivotal guide member.

It is preferable that the pivotal guide member includes an interfering portion with which the leading end of the sheet moving from the first conveyance path toward the second conveyance path interferes, a horizontal portion extending horizontally from the bottom end of the interfering position toward the second conveyance path and a leading end portion extending further toward the second conveyance path from the horizontal portion; and that the interfering portion and the horizontal portion project from the curved guide surface while a part of the leading end portion interferes with an edge portion of the window, thereby preventing the interfering portion and the horizontal portion from excessively projecting from the curved guide surface. According to this construction, an unnecessary pivotal movement of the pivotal guide member toward the first conveyance path is inhibited and the sheet can be stably conveyed via the pivotal guide member.

In this case, it is preferable that an inclined portion is upwardly provided between the horizontal portion and the leading end portion; and that the inclined portion locates the leading end portion on a surface of the curved guide plate opposite to the curved guide surface via the window.

An image forming apparatus according to another aspect of the present invention comprises an image forming station for forming an image on a sheet; a main conveyance path for conveying the sheet toward the image forming station; and a sheet reversing device for reversing the sheet having an image formed on one side thereof in the image forming station and returning it to the main conveyance path, wherein the sheet reversing device has the above construction.

According to such an image forming apparatus, functions and effects of the above sheet reversing device can be enjoyed, and duplex printing can be constantly smoothly applied to a sheet.

This application is based on Japanese Patent Application Serial No. 2009-089227 filed in Japan Patent Office on Apr. 1, 2009, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A sheet reversing device, comprising:

a first conveyance path that extends vertically;

a second conveyance path that extends horizontally, into which a sheet is carried along a sheet conveyance direction from the first conveyance path and from which the sheet is carried out after being switched back;

a third conveyance path that extends horizontally, receives and conveys the sheet carried out from the second conveyance path;

a curved guide plate disposed between the first and second conveyance paths and including a curved guide surface for guiding the sheet to the second conveyance path; and a pivotal guide member pivotably supported with a part thereof projecting from the curved guide surface, wherein the pivotal guide member pivots to be retracted into an inner side of the curved guide surface by being pushed by the sheet moving along the sheet conveyance direction from the first conveyance path toward the second conveyance path while guiding the sheet switched back after a trailing end of the sheet moved in the sheet conveyance direction passes the pivotal guide member so that the sheet that is switched back is carried out from the second conveyance path toward the third conveyance path by the part of the pivotal guide member projecting from the curved guide surface.

2. A sheet reversing device according to claim 1, further comprising a supporting member for suspending the pivotal guide member at a swing pivot of the pivotal guide member.

3. A sheet reversing device according to claim 2, wherein:

the supporting member is arranged above the curved guide surface;

the curved guide surface includes a window for allowing passage of the pivotal guide member; and the pivotal guide member is suspended on the supporting member with a part thereof projecting from the window in a stationary state.

4. A sheet reversing device according to claim 3, wherein:

the curved guide plate includes a supporting plate portion above the curved guide surface; and the supporting member is supported by the supporting plate portion.

5. A sheet reversing device according to claim 1, wherein:

the pivotal guide member includes:

an interfering portion with which a leading end of the sheet moving from the first conveyance path toward the second conveyance path interferes, and a horizontal portion extending horizontally from a bottom end of the interfering position toward the second conveyance path; and the interfering portion and the horizontal portion constitute parts of the pivotal guide member projecting from the curved guide surface.

6. A sheet reversing device according to claim 1, wherein the pivotal guide member includes a stopper for preventing a pivotal movement of the pivotal guide member toward the first conveyance path by interference with a part of the curved guide plate.

7. A sheet reversing device according to claim 3, wherein:

the pivotal guide member includes:

an interfering portion with which a leading end of the sheet moving from the first conveyance path toward the second conveyance path interferes, a horizontal portion extending horizontally from a bottom end of the interfering position toward the second conveyance path, and a leading end portion extending further toward the second conveyance path from the horizontal portion; and the interfering portion and the horizontal portion project from the curved guide surface while a part of the leading end portion interferes with an edge portion of the window, thereby preventing the interfering portion and the horizontal portion from excessively projecting from the curved guide surface.

8. A sheet reversing device according to claim 7, wherein:

an inclined portion is upwardly provided between the horizontal portion and the leading end portion; and the inclined portion locates the leading end portion on a surface of the curved guide plate opposite to the curved guide surface via the window.

9. An image forming apparatus, comprising:

an image forming station for forming an image on a sheet;

a main conveyance path for conveying the sheet toward the image forming station; and a sheet reversing device for reversing the sheet having an image formed on one side thereof in the image forming station and returning it to the main conveyance path, wherein the sheet reversing device includes:

a first conveyance path that extends vertically;

a second conveyance path that extends horizontally, into which a sheet is carried along a sheet conveyance direction from the first conveyance path and from which the sheet is carried out after being switched back;

a third conveyance path that extends horizontally, receives and conveys the sheet carried out from the second conveyance path;

a curved guide plate disposed between the first and second conveyance paths and including a curved guide surface for guiding the sheet to the second conveyance path; and a pivotal guide member pivotably supported with a part thereof projecting from the curved guide surface, wherein the pivotal guide member pivots to be retracted into the inner side of the curved guide surface by being pushed by the sheet moving along the sheet conveyance direction from the first conveyance path toward the second conveyance path while guiding the sheet switched back after a trailing end of the sheet moved in the sheet conveyance direction passes the pivotal guide member so that the sheet that is switched back is carried out from the second conveyance path toward the third conveyance path by the part of the pivotal guide member projecting from the curved guide surface.

10. An image forming apparatus according to claim 9, further comprising a supporting member for suspending the pivotal guide member at a swing pivot of the pivotal guide member.

11. An image forming apparatus according to claim 10, wherein:

the supporting member is arranged above the curved guide surface;

the curved guide surface includes a window for allowing passage of the pivotal guide member; and the pivotal guide member is suspended on the supporting member with a part thereof projecting from the window in a stationary state.

12. An image forming apparatus according to claim 11, wherein:

the curved guide plate includes a supporting plate portion above the curved guide surface; and the supporting member is supported by the supporting plate portion.

13. An image forming apparatus according to claim 9, wherein:

the pivotal guide member includes:

an interfering portion with which a leading end of the sheet moving from the first conveyance path toward the second conveyance path interferes, and a horizontal portion extending horizontally from the bottom end of the interfering position toward the second conveyance path; and the interfering portion and the horizontal portion constitute parts of the pivotal guide member projecting from the curved guide surface.

14. An image forming apparatus according to claim 9, wherein the pivotal guide member includes a stopper for preventing a pivotal movement of the pivotal guide member toward the first conveyance path by interference with a part of the curved guide plate.

15. An image forming apparatus according to claim 11, wherein:

the pivotal guide member includes:

an interfering portion with which a leading end of the sheet moving from the first conveyance path toward the second conveyance path interferes, a horizontal portion extending horizontally from the bottom end of the interfering position toward the second conveyance path, and a leading end portion extending further toward the second conveyance path from the horizontal portion; and the interfering portion and the horizontal portion project from the curved guide surface while a part of the leading end portion interferes with an edge portion of the window, thereby preventing the interfering portion and the horizontal portion from excessively projecting from the curved guide surface.

16. An image forming apparatus according to claim 15, wherein:

an inclined portion is upwardly provided between the horizontal portion and the leading end portion; and the inclined portion locates the leading end portion on a surface of the curved guide plate opposite to the curved guide surface via the window.

* * * * *